US006981290B2

(12) United States Patent
Terzuola

(10) Patent No.: US 6,981,290 B2
(45) Date of Patent: Jan. 3, 2006

(54) WIRE CUTTER AND BAYONET SHEATH COMBINATION

(75) Inventor: Robert Terzuola, Sante Fe, NM (US)

(73) Assignee: Camillus Cutlery Company, Camillus, NY (US)

( * ) Notice: Subject to any disclaimer, the term of this patent is extended or adjusted under 35 U.S.C. 154(b) by 155 days.

(21) Appl. No.: 10/457,155

(22) Filed: Jun. 9, 2003

(65) Prior Publication Data

US 2004/0244119 A1 Dec. 9, 2004

(51) Int. Cl.
*B26B 11/00* (2006.01)

(52) U.S. Cl. ..... 7/158; 30/138; 224/232

(58) Field of Classification Search ..... 7/129, 7/158; 30/123, 138, 143, 151; 224/232
See application file for complete search history.

(56) References Cited

U.S. PATENT DOCUMENTS 318,346 A * 5/1885 Bramberg ..... 7/131
4,502,218 A * 3/1985 Carter et al. ..... 30/138
4,720,030 A * 1/1988 Petrovich ..... 224/232
4,805,818 A * 2/1989 Harrison ..... 224/232
4,821,356 A * 4/1989 Finn ..... 7/134

* cited by examiner

*Primary Examiner*—James G. Smith
(74) *Attorney, Agent, or Firm*—George R. McGuire; Bond, Schoeneck & King, PLLC

(57) ABSTRACT

The present invention provides a scabbard for a combat knife and cutting tool combination. The scabbard generally comprises a body extending along a longitudinal axis between first and second ends, and includes a channel formed therethrough that extends in spaced, parallel to the longitudinal axis, and a cavity that extends along the longitudinal axis. The cutting tool comprises first and second legs pivotally interconnected to one another that extend along longitudinal first and second axes, respectively, with the first leg being removably positionable within the channel of the scabbard, and the second leg being movable relative to the scabbard, but held firmly in position by a releasable strap when the tool is not in use. A combat knife is removably positionable in the cavity of the scabbard.

19 Claims, 6 Drawing Sheets

11
11
12
12
46
48
48
48
50
50
50
51
51
52
52
54
54
54
56
56
58
58
58
60
60
62
62
68
68
68
70

WIRE CUTTER AND BAYONET SHEATH COMBINATION

BACKGROUND OF THE INVENTION

1. Field of Invention

The present invention relates generally to combat knife scabbards, and more particularly to scabbards having a wire cutting tool provided therewith.

2. Description of Prior Art

Combat knives and bayonets are sometimes held in scabbards that may be worn on a person. Often, a wire cutting tool is separately incorporated with the knife and scabbard, or provided as an integral feature of the knife and scabbard. The purpose of the cutting tool is generally to cut through wire, such as chain link fencing, or to snip metal, thereby adding functionality to the knife and scabbard combination.

In their most traditional form, the scabbard and cutting tool combinations comprise a bolt or boss protruding outwardly from one surface of the scabbard. The knife includes one edge that is beveled in a manner making it conducive to cutting wire, and includes an opening formed through the body of the blade that is adapted to securely engage the bolt or boss protruding from the scabbard. The scabbard includes either as an integral part thereof, or as a separate component securely attached thereto, a beveled edge that functions as the second edge of the cutting tool.

In order to cut wire, a user would remove the knife from the scabbard, interconnect the blade to the scabbard by forcibly engaging the boss through the opening formed in the blade. Wire may then be clipped by pivotally moving the blade relative to the scabbard such that the wire cutting edge on the knife blade shearingly moves relative to the wire cutting edge formed as part of the scabbard. While very functional and useful, tools constructed in this manner are relatively time consuming and difficult to assemble. Examples of such types of tools are exemplified in U.S. Pat. No. 3,842,458 to Bauer, U.S. Pat. No. 4,805,818 to Harrison, U.S. Pat. No. 4,821,356 to Finnand, and U.S. Pat. No. 5,594,967 to Morton et al.

Another type of wire cutting tool and scabbard combination includes a cutting tool that is separate from the knife and incorporated into the scabbard. This type of assembly includes a cutting tool arm that is pivotally movable relative to the scabbard and includes a cutting surface attached to one end thereof. The second surface is formed as an integral part of the scabbard at one end thereof. A strap or other closure element retains the movable arm in fixed relation to the scabbard when not in use. In operation, a user releases the strap and pivotally moves the movable arm relative to the scabbard in order to cut through the wire or other material. Although this type of tool is quicker and easier to set up and use than the typical tool previously described, because it must be used in combination with the scabbard which also serves to hold the knife, its usefulness is some what limited and it is some what cumbersome to maneuver and use. A representative example of this type of knife is described in U.S. Pat. No. 4,720,030 to Petrovich.

OBJECTS AND ADVANTAGES

It is therefore a principal object and advantage of the present invention to provide a cutting tool that may be used in conjunction with or apart from a scabbard.

It is an additional object and advantage of the present invention to provide a cutting tool that includes several types of tools incorporated therein.

Other objects and advantages of the present invention will in part be obvious, and in part appear hereinafter.

SUMMARY OF THE INVENTION

In accordance with the foregoing objects and advantages, the present invention provides a scabbard for a combat knife and cutting tool combination. The scabbard generally comprises a body extending along a longitudinal axis between first and second ends, and includes a channel formed therethrough that extends in spaced, parallel to the longitudinal axis, and a cavity that extends along the longitudinal axis. The cutting tool comprises first and second legs pivotally interconnected to one another that extend along longitudinal first and second axes, respectively, with the first leg being removably positionable within the channel of the scabbard, and the second leg being movable relative to the scabbard, but held firmly in position by a releasable strap when the tool is not in use. A combat knife is removably positionable in the cavity of the scabbard.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
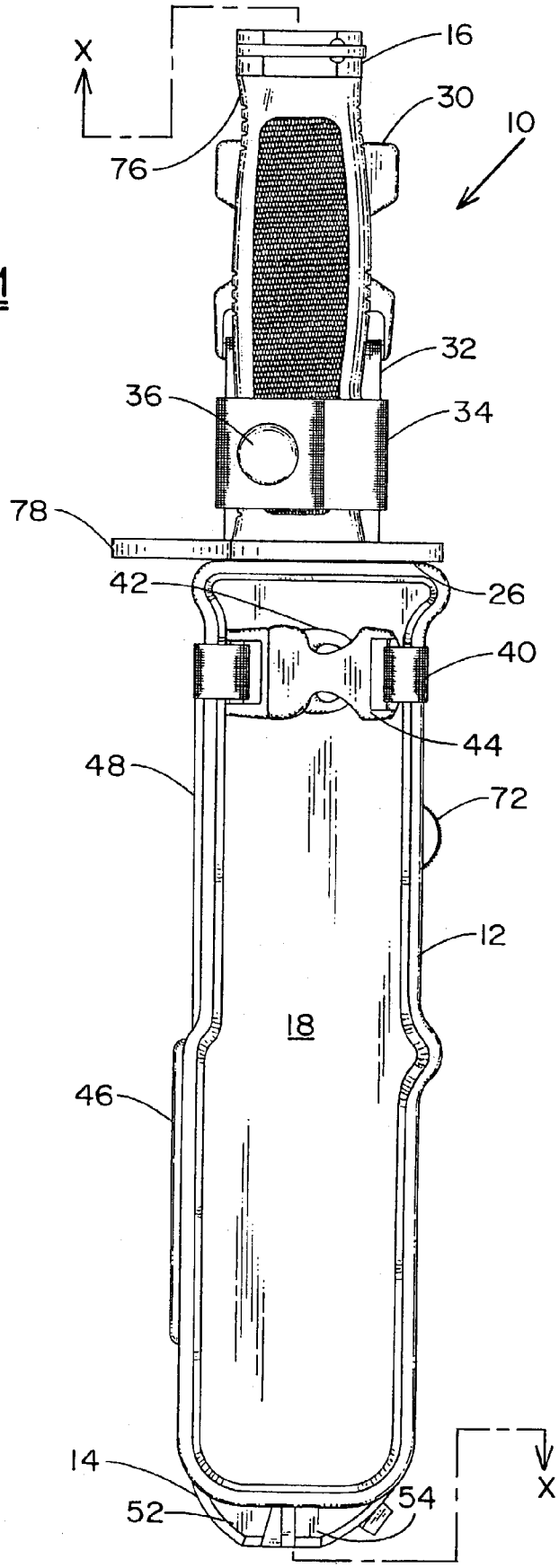
FIG. 1 is a top plan view of the present invention with a combat knife and cutting tool both securely positioned relative to a scabbard.
Figures 2, 3:
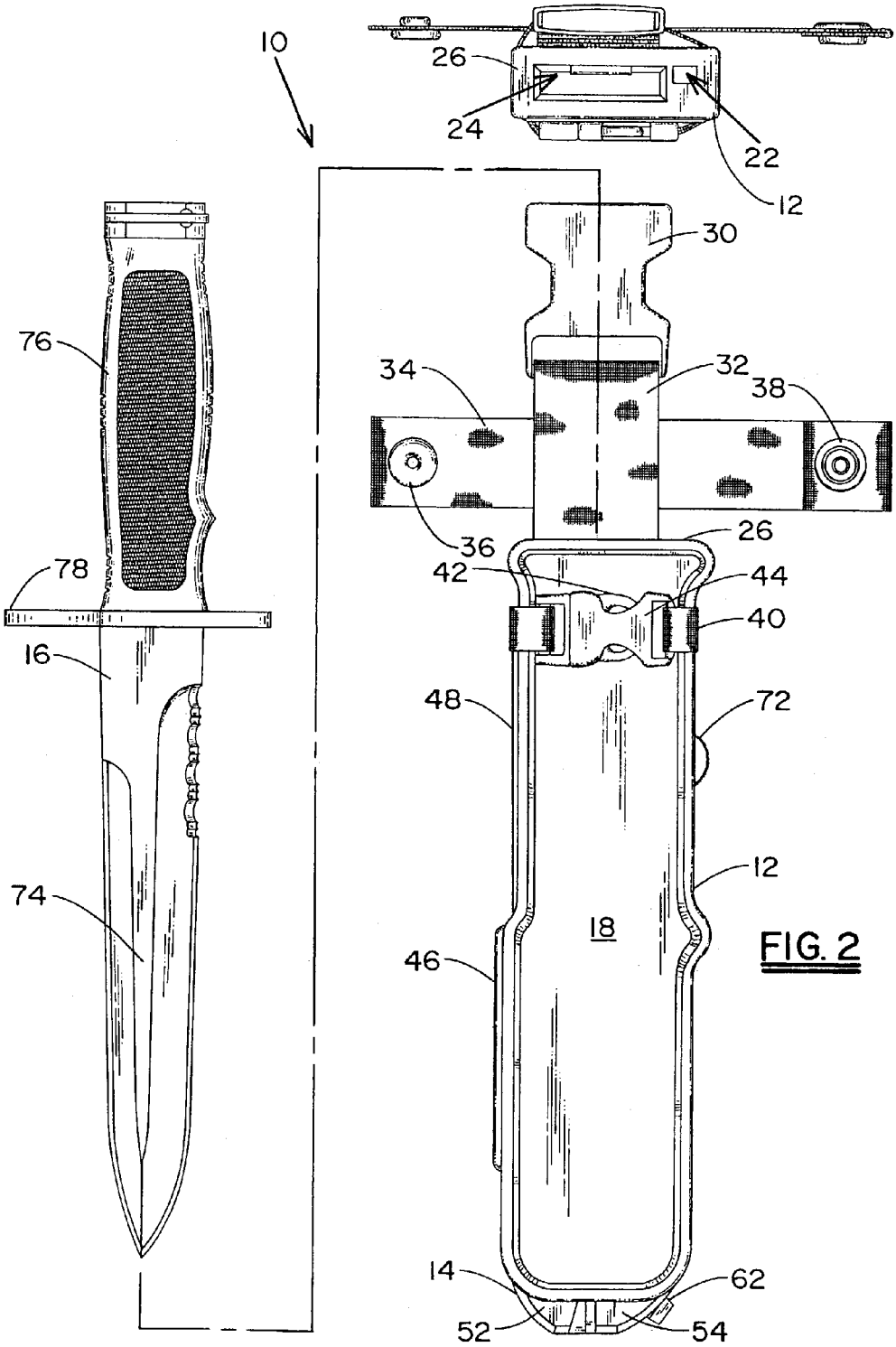
FIG. 2 is an exploded top plan view of the present invention showing the combat knife in spaced realtion to the scabbard.
FIG. 3 is an end elevation view of the scabbard.
Figure 4:
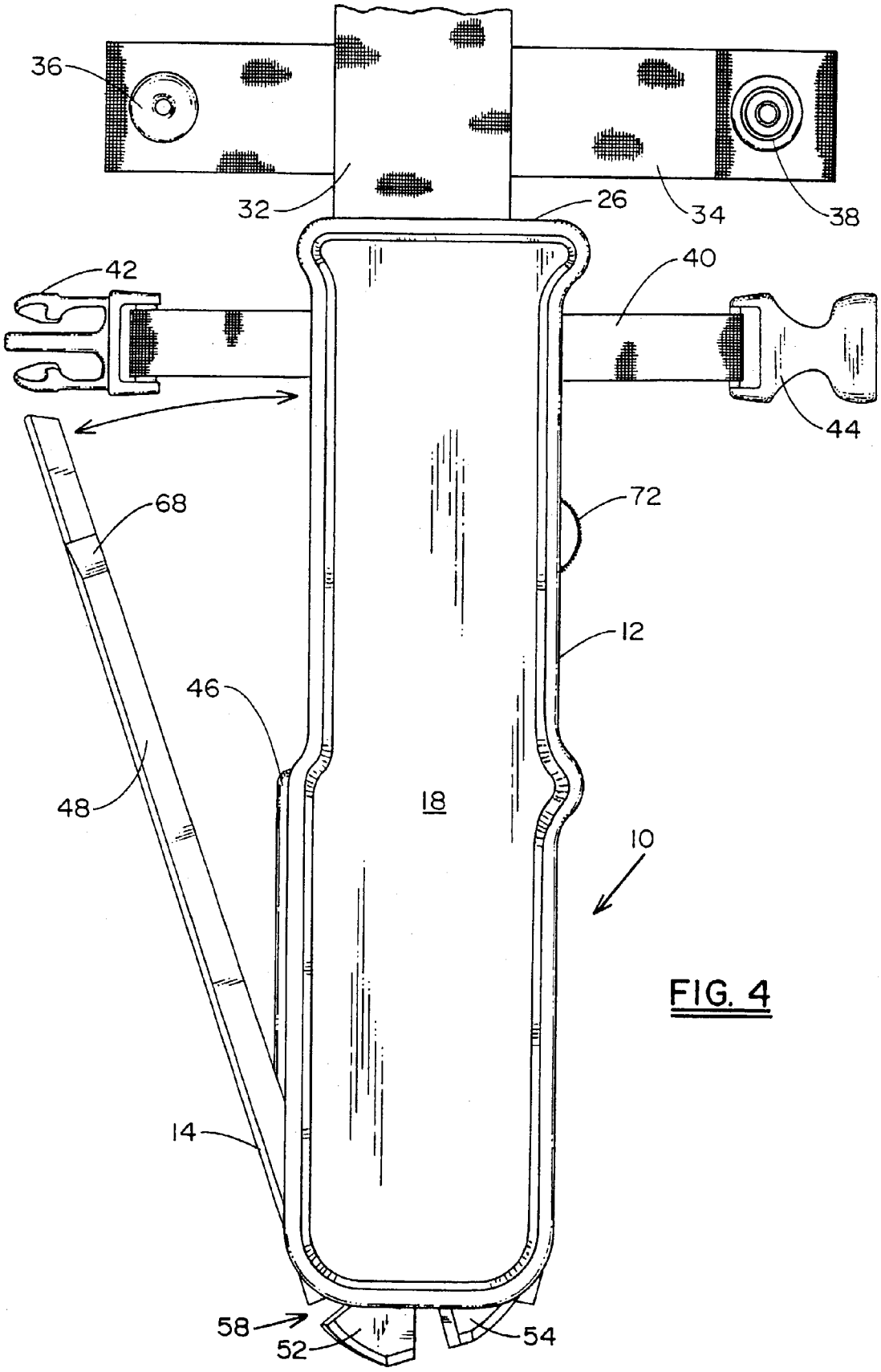
FIG. 4 is a top plan view of the scabbard and cutting tool, with the cutting tool shown with one leg pivotally moved away from the scabbard.
Figure 5:
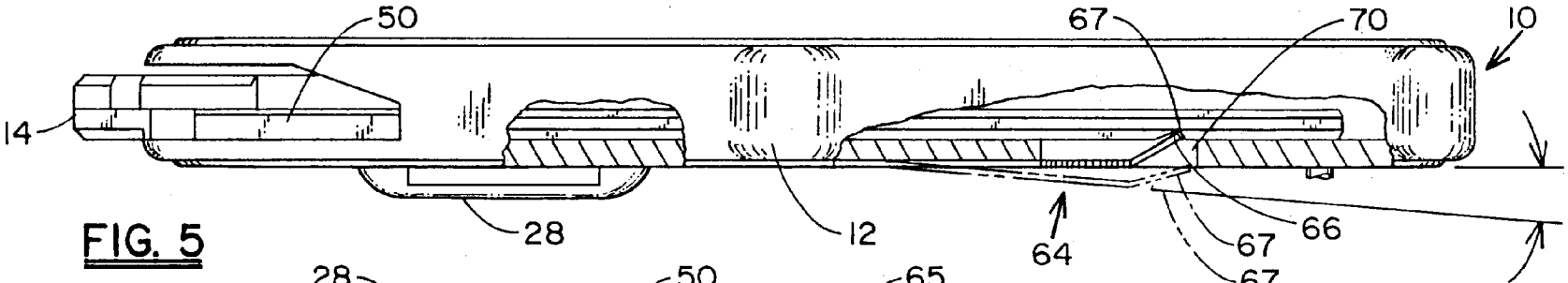
FIG. 5 is a partial cut-away, side elevation view illustrating the cutting tool locking feature of the scabbard.

Referring now to the drawings, wherein like reference numerals refer to like parts throughout, there is seen in FIG. 1 a combination tool, designated generally by reference numeral 10, generally comprising a scabbard 12, a cutting tool 14, and a combat knife 16. As will be explained in greater detail hereinafter, scabbard 12 is adapted to be worn on the belt of a person and carry cutting tool 14 and combat knife 16 therein.

Scabbard 12 generally comprises a body having front and rear major surfaces 18, 20, and extends along a longitudinal axis X—X. An elongated channel 22 is formed through scabbard 12, extending in spaced, parallel relation to longitudinal axis X—X, and a cavity 24 is formed in the top end 26 of scabbard 12 and extends along axis X—X. A belt loop fixture 28 is attached to rear surface 20 to permit scabbard 12 to be attached to a person via a belt, and a conventional female connector 30 fixed to the end of a flexible strap 32 is also attached to rear surface 20 to securely clip scabbard 12 to a corresponding male connector (not shown) that may be fixed to a person's clothing, thereby permitting a quick release type of connector for scabbard 12. A knife handle strap 34 with conventional male and female snaps 36, 38 on either end is attached to and extends transversely across strap 32 for wrapping around the handle of knife 16 when it's positioned in scabbard 12, thereby preventing it from inadvertently falling out of the scabbard. Scabbard 12 further comprises a flexible, cutting tool strap 40 attached to and extending transversely across its rear surface 20 and that includes conventional male and female connectors 42, 44 attached to either end (the structural relation of strap 40 to cutting tool 14 will be explained in greater detail hereinafter). A knife edge sharpening tool 46 is attached to or made an integral part of scabbard 12, protruding outwardly from and extending along one edge thereof. Finally, at least a portion of rear surface 20 and top end 26 are coated with a plastic, rubber, or other sound dampening material to diminish any noise scabbard 12 may make when contacting a wearer or having knife 16 removed therefrom or inserted therein.

Cutting tool 14 includes a pair of arms 48, 50 pivotally interconnected to one another by a pin 51, and a pair of cutting heads 52, 54 securely carried by arms 48, 50, respectively. When brought together, cutting heads 52, 54 form a wire snipping slot 56, a fiber cord snipping slot 58, and a tin snipping slot 60 between corresponding sets of surfaces collectively comprising cutting heads 52, 54. A flat head screwdriver edge 62 is also formed on an outwardly facing surface of cutting head 48.

Figures 8, 9, 10, 11, 12:
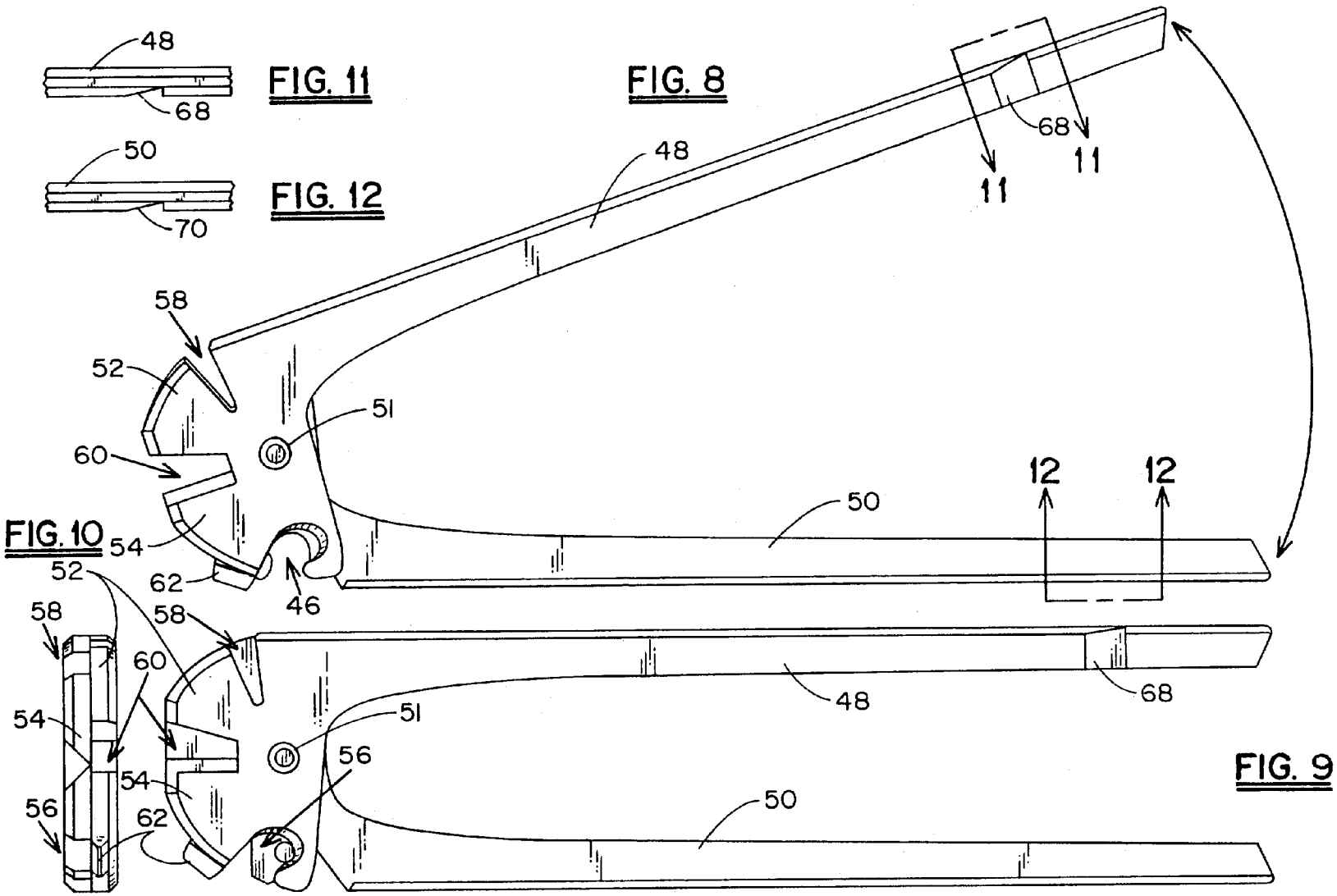
FIG. 8 is a top plan view of the cutting tool in a partially open position.
FIG. 9 is a top plan view of the cutting tool in its closed position.
FIG. 10 is a front elevation view of the cutting tool in its closed position.
FIG. 11 is a cross-sectional view of the cutting tool taken along line 11—11 of FIG. 8.
FIG. 12 is a cross-sectional view of the cutting tool taken along line 12—12 of FIG. 8.

Cutting tool 14 is removably securable to scabbard 12. When secured to scabbard 12, arm 48 (or arm 50, as arms 48 and 50 are substantially identical to one another) is slidably positioned within channel 22 and arm 50 (or arm 48) is positioned in contacting relation with the side of scabbard 12 and held in position by strap 40, with both arms extending in spaced, parallel relation to axis X—X. To prevent tool 14 from sliding out of scabbard 12, a cutting tool locking mechanism 64 is incorporated into scabbard 12. Locking mechanism 64 comprises a plate biased at one end 65 and a locking tab 66 formed on its free end 67. Locking tab 66 engages a notch 68 (or 70) formed on leg 48 (or 50) when leg 48 (or 50) is positioned within channel 22, with the bias imparted on the plate locking tab 66 in notch 68 (or 70), as illustrated in FIG. 8. As illustrated in FIGS. 11 and 12, notches 68 and 70 are formed in corresponding positions on opposite sides of legs 48 and 50, respectively, thereby permitting tool 14 to have either leg 48 or 50 inserted into channel 22.

Figure 7:
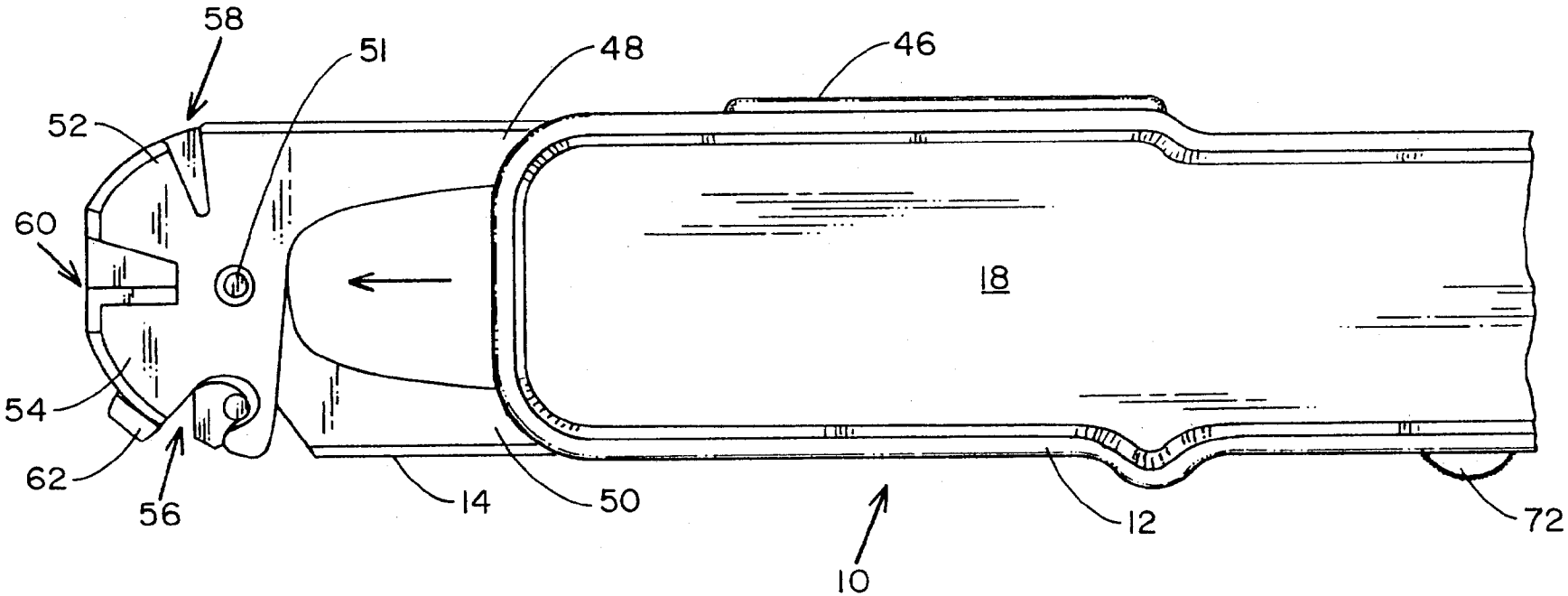
FIG. 7 is a partial, top plan view of the scabbard and cutting tool, with the cutting tool shown being removed from the scabbard.

To release locking mechanism 64, a release tab 72 is formed on the plate between its two ends 65, 67. Release tab 72 extends outwardly from scabbard 12, permitting engagement by a user's finger/thumb. To disengage tab 66 from notch 68 (or 70), a user would engage tab 72 with his/her finger and apply an outwardly directed force away from scabbard 12, thereby causing locking tab 72 to disengage from notch 68 (or 70), and permit tool 14 to permit arm 48 (or 50) to freely slide out of channel 22, as illustrated by the directional arrow in FIG. 7.

Figure 6:
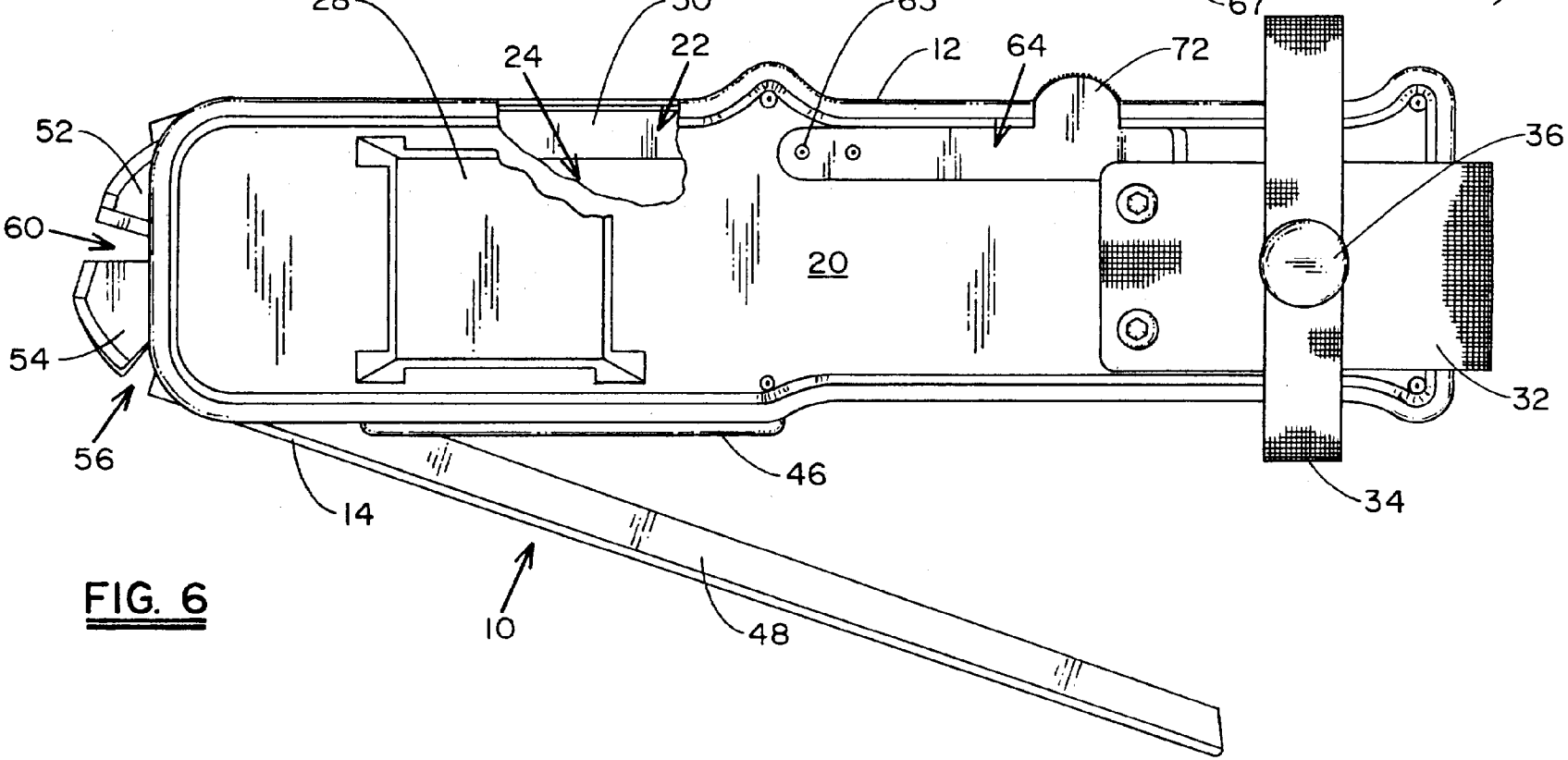
FIG. 6 is partial cut-away, bottom plan view illustrating the position of the cutting tool arms relative to the scabbard.

In addition to being separable from scabbard 12 (and operable when it is separated), cutting tool 14 may also be operated when it is attached to scabbard 12. When it is attached, strap 40 is released, thereby freeing arm 48 (or 50) to move relative to scabbard 12, while the other arm 50 (or 48) remains locked in channel 22. When tool 14 is in attached relation to scabbard 12, cutting heads 52 and 54 are operably positioned in slightly spaced relation from the end of scabbard 12, such that a user can operate tool 14 by holding scabbard 12 with one hand while operating the free arm 48 (or 50 of tool 14 with the other, as partially illustrated in FIG. 6.

Combat knife 16 is conventional in that it includes a blade 74, handle 76, and rifle mounting plate 78 positioned between blade 74 and handle 76 (for bayonet style combat knives). Plate 78 is generally constructed of metal. Thus, by coating the end 26 of scabbard 12 with a sound dampening material, insertion of knife 16 into scabbard 12 will be relatively quiet, as opposed to the sound that would be produced if scabbard 12 was made of a non-dampening material. As previously indicated, when knife 16 is positioned with its blade 74 in cavity 24, a strap 32 may be wrapped around handle 76 to secure it in position. To release knife 16 from scabbard 12, strap 32 is simply unclasped/unsnapped, thereby freeing knife 16 to be removed from scabbard 12.

What is claimed is:

1. A combination scabbard and cutting tool, comprising:

a. a scabbard comprising a body extending along a longitudinal axis between first and second ends, and having a channel formed in said body;

b. a cutting tool comprising first and second legs pivotally interconnected to one another, and extending along longitudinal first and second axes, respectively, said first leg being removably positionable within said channel; and c. first and second cutting heads carried by said first and second legs, respectively, said first and second cutting heads being operably positioned adjacent said first end of said scabbard when said first leg is positioned within said channel.

2. The combination scabbard and cutting tool according to claim 1, wherein said scabbard includes a cavity formed therein that extends along said scabbard longitudinal axis.

3. The combination scabbard and cutting tool according to claim 2, further comprising a combat knife removably positionable within said cavity.

4. The combination scabbard and cutting tool according to claim 1, further comprising a knife blade sharpening tool attached to said scabbard.

5. The combination scabbard and cutting tool according to claim 1, further comprising a cutting tool strap attached to said scabbard.

6. The combination scabbard and cutting tool according to claim 1, further comprising a knife retaining strap attached to said scabbard.

7. The combination scabbard and cutting tool according to claim 1, further comprising a belt loop attached to said scabbard.

8. The combination scabbard and cutting tool according to claim 1, further comprising a connector attached to said scabbard for attaching said scabbard to a user of said combination scabbard and cutting tool.

9. The combination scabbard and cutting tool according to claim 1, further comprising a cutting tool locking mechanism attached to said scabbard.

10. The combination scabbard and cutting tool according to claim 9, wherein said locking mechanism comprises a plate having first and second ends, said first end being attached to said scabbard and said second end having a locking tab formed thereon.

11. The combination scabbard and cutting tool according to claim 1, further comprising means for locking said cutting tool in said scabbard.

12. The combination scabbard and cutting tool according to claim 11, wherein said means for locking said cutting tool in said scabbard comprise:

1. a notch formed in said first leg of said cutting tool;
2. a plate having first and second ends, said first end being attached to said scabbard and said second end having a locking tab formed thereon; and
3. wherein said locking tab engages said notch when said first leg is positioned within said channel.

13. The combination scabbard and cutting tool according to claim 12, further comprising means for disengaging said tab from said notch.

14. The combination scabbard and cutting tool according to claim 13, wherein said means for disengaging said tab from said notch comprises a release tab attached to said plate, whereby force applied to said release tab in a direction away from said scabbard causes said locking tab to disengage said notch.

15. The combination scabbard and cutting tool according to claim 12, wherein said second leg of said cutting tool includes a notch formed therein.

16. The combination scabbard and cutting tool according to claim 1, wherein said first and second cutting heads collectively form a wire snipping slot.

17. The combination scabbard and cutting tool according to claim 1, wherein said first and second cutting heads collectively form a tin snipping slot.

18. The combination scabbard and cutting tool according to claim 1, wherein said first and second cutting heads collectively form a fiber cord snipping slot.

19. The combination scabbard and cutting tool according to claim 1, wherein said first cutting head includes a screwdriver edge formed thereon.

* * * * *